United States Patent [19]

Okutsu

[11] Patent Number: 4,828,968

[45] Date of Patent: May 9, 1989

[54] METHOD OF DEVELOPING PHOTOGRAPHIC LIGHT-SENSITIVE MATERIALS

[75] Inventor: Eiichi Okutsu, Minami-ashigara, Japan

[73] Assignee: Fuji Photo Film Co., Ltd., Minami-ashigara, Japan

[21] Appl. No.: 919,077

[22] Filed: Oct. 15, 1986

[30] Foreign Application Priority Data

Oct. 18, 1985 [JP] Japan ..... 60-232471

[51] Int. Cl.[4] ..... G03C 5/24; G03C 5/30; G03C 5/54

[52] U.S. Cl. ..... 430/398; 430/399; 430/421; 430/436; 430/437; 430/264

[58] Field of Search ..... 430/421, 436, 437, 447, 430/398, 399, 264

[56] References Cited

U.S. PATENT DOCUMENTS 3,970,457 7/1976 Parsonage ..... 430/399
4,025,344 5/1977 Allen et al. ..... 430/399
4,228,234 10/1980 Okutsu et al. ..... 430/265
4,297,437 10/1981 Kaneko et al. ..... 430/376

FOREIGN PATENT DOCUMENTS 2004893 2/1970 Fed. Rep. of Germany ..... 430/399

*Primary Examiner*—Paul R. Michl
*Assistant Examiner*—Patrick A. Doody
*Attorney, Agent, or Firm*—Burns, Doane, Swecker & Mathis

[57] ABSTRACT

Silver halide photographic light-sensitive materials containing a hydrazine derivative is developed in high contrast by means of an automatic processor, wherein a replenisher less active than a starting developer used at the beginning of development is supplied in a predetermined amount per unit time and, in the case where further replenishment is done in excess of said predetermined amount in said unit time, a replenisher having activity substantially equivalent to that of said starting developer used at the beginning of development is then supplied. Stable treatment results are attained for a long time.

11 Claims, No Drawings

METHOD OF DEVELOPING PHOTOGRAPHIC LIGHT-SENSITIVE MATERIALS

BACKGROUND OF THE INVENTION

1. Field of the Invention

The present invention relates to a method of developing silver halide light-sensitive materials by means of an automatic processor, particularly to a method for forming high-contrast negative images suitable to photomechanical process for printing of graphic arts by means of an automatic processor.

2. Description of the Prior Art

In the field of graphic arts, an image forming system giving high-contrast photographic properties is required to obtain good reproduction of images of continuous gradation or good reproduction of line images by dotted patterns.

Hitherto, a special developer, called a litho-developer, has been used. The litho-developer contains only hydroquinone as the developing agent, and sulfite in the form of an adduct with formaldehyde to prevent infectious development. The concentration of free sulfite ion is kept extremely low. Accordingly as a result, the litho-developer is easily oxidized by air and cannot be stored for more than three days, which is serious disadvantage.

For obtaining high-contrast photographic properties using a stable developer, a method where hydrazine derivatives are used is known and described for example in U.S. Pat. Nos. 4,224,401; 4,168,977; 4,166,742; 4,311,781; 4,272,606; 4,211,857; and 4,243,739. According to this method, photographic properties of high contrast and high sensitivity are obtained and it is permissible to add sulfite at high concentration levels to a developer. With this method the stability of the developer to air oxidation is remarkably enhanced compared with the litho-methods.

However, when these hydrazine derivatives are used, the pH of the developer is set to a value higher than that of a typical litho-developer and, therefore, the pH value tends to vary. Accordingly, there is a problem in that changes in the pH value cause scattering of photographic properties.

U.S. Pat. No. 4,269,929 describes a method where an amino compound is added to an alkaline developer containing a dihydroxybenzene and a 3-pyrazolidone as a developing agent to raise activity of the developer. As a result sensitization and contrasting are effected in a developer of a lower pH value. However, even in this manner, it is difficult to obtain stable photographic properties for long periods of time such as from 1 to 12 months under varying treatment conditions in cases where the area of films to be treated is large or small.

Further, it is proposed to stabilize photographic properties by improving the manner of replenishing a developer in Japanese Patent Applications (unexamined) Nos. 68725/1974, 110329/1976, 23631/1978, 94926/1978, 100232/1978, 103349/1979 and 44438/1983. However, these methods may be used only in the case of a litho-developer and, accordingly, aging deterioration and deterioration by developing are taken into consideration in the manner of replenishment. The is no description relating to a method for replenishment to stably treat silver halide photographic materials containing a hydrazine derivative for long periods of time by means of an automatic processor and to obtain high contrast images.

SUMMARY OF THE INVENTION

In a high contrast system where hydrazine is used and a $\gamma$ value is at least 10, the activity of the developer increases by air oxidation of the developer, whereby the sensitivity increases and black peppers appear. In order to prevent this, the liquid activity of the replenished developer has been set lower than that of a starting developer when an automatic processor is used. However, when the treated amount of light-sensitive materials per unit time is large, the supplied amount of a less active replenisher becomes large and, therefore, the liquid activity decreases gradually. Thus, a purpose of the present invention is to provide a method of replenishing a developer to stably treat silver halide photographic materials containing a hydrazine derivative by means of an automatic processor for long periods of time (e.g., 1 to 12 months) and to obtain high contrast images.

The purpose of the invention is obtained by a method of developing silver halide photographic light-sensitive materials containing a hydrazine derivative in high contrast by means of an automatic processor, characterized in that a replenisher which is less active than the starting developer used at the beginning of development is supplied in a predetermined amount per unit time and, in the case where further replenishment is done in excess of the aforesaid predetermined amount in the above unit time, a replenisher having activity substantially equivalent to that of the developer used at the beginning of development is supplied.

A major reason for use of the replenisher having less activity is to adust an increase in pH due to the oxidation of a developer as stated above. That is to say, the increase in pH by oxidation is much larger, than the decrease in pH by development treatment. In order to offset this, a less active replenisher is used. However, when the treated amount of light-sensitive materials per unit time is increased and the supplied amount of the less active replenisher is accordingly increased, the supplied amount of the less active replenisher exceeds the amount per unit time required for adjusting the rise in pH due to oxidation. As a result, photographic properties, such as sensitivity, deteriorate. The present invention effectively addresses these problems.

"A less active replenisher" as used herein refers to the situation wherein the photographic sensitivity of silver halide light-sensitive materials containing a hydrazine derivative developed under certain conditions using a replenisher, is lower than the photographic sensitivity in those situations wherein they are developed using a developer used at the beginning of development. Herein, the photographic sensitivity is represented by the reciprocal of an exposure value which gives an optical density of 1.5. The expression that photographic sensitivity is low herein means that a sensitivity value is not higher than 95%.

Any replenisher may be used in the invention so long as its activity is lower than that of a developer used at the beginning of development (hereinafter referred to as a starting developer). For instance, a liquid having a pH lower than that of the starting developer, a liquid obtained by diluting the starting developer with water, a liquid containing an organic antifoggant in an amount larger than that in the starting developer, and a liquid containing a developing agent in an amount smaller than that in the starting dveloper, may all be used.

Herein, the difference in pH between the replenisher and a starting developer is preferably 0.05 to 0.2. In the case of dilution with water, a ratio of diluting water to the starting developer is preferably 0.05 to 0.2. The difference in a content of an organic antifoggant is preferably 20 to 50%.

Among the above, a method using the liquid obtained by diluting a starting developer with water is particularly preferred because the manner of supplying a replenisher is simple and convenient.

The predetermined total amount of a less active replenisher to be supplied in certain unit time (hereinafter, referred to as the total amount to be replenished) is generally determined by the length of the unit time (which is conveniently one day), but may vary depending on, for instance, the activity of a starting developer, the activity of a replenisher, the type of automatic processor, the amount of developer and the type of light-sensitive materials. However, once these developing conditions are determined, it is easy to determine in advance the total amount to be replenished based on the above conditions. For instance, the total amount to be replenished of a less active replenisher per unit time (e.g., one day) may be determined by knowing the amount of the less active replenisher required to make the following two liquid activities at the same level: (1) a liquid activity at the restarting of an automatic processor the next morning (i.e., 24 hours after the beginning of development) after the processor is operated for an average operating time of a day without supplying a replenisher and the processing operation is stopped, provided that only a starting developer is supplied to a developing bath of the automatic processor at the beginning of development; and (2) the liquid activity at the beginning of development.

A replenisher of the total amount to be replenished may be supplied per certain unit time in various manners. For instance, it may be supplied in a certain amount per certain amount of light-sensitive materials to be treated, e.g., per piece. A replenisher based on the total amount to be replenished may be equally divided in accordance with an average amount of treated light-sensitive materials per day. If the total sum of replenisher supplied in a certain time does not amount to the aforesaid total amount to be replenished, the deficient amount may be added at any time during the certain time, e.g., at the end of development operations in a day or before the starting of development treatment in the next day (replenishment manner A).

In the case where a replenisher is supplied in accordance with the amount of light-sensitive materials to be treated, and, as a result, the total of the supplied replenisher amounts to a predetermined amount (i.e., the total amount to be replenished), a replenisher having activity substantially the same as that of the starting developer is thereafter supplied in accordance with the amount of light-sensitive materials to be treated (replenishment manner B).

In embodiments of the development method according to the invention, the aforesaid replenishment manners A and B may be used alternatively at a constant interval of time, or both may be used in combination.

By the present invention, it is preferable to use a dihydroxybenzene compound as a developing agent in a developer and a p-aminophenol or 3-pyrazolidone compound auxiliary developing agent. However, an auxiliary developing agent may be omitted.

Examples of dihydroxybenzene compounds include hydroquinone, chlorohydroquinone, bromohydroquinone, isopropylhydroquinone, methylhydroquinone, 2,3-dichlorohydroquinone, 2,3-dibromohydroquinone, and 2,5-dimethylhydroquinone with hydroquinone being preferred.

Examples of 1-phenyl-3-pyrazolidone or derivatives thereof as an auxiliary developing agent include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, and 1-p-tolyl-4,4-dimethyl-3-pyrazolidone.

Examples of p-aminophenol type auxiliary developing agents including N-methyl-p-aminophenol, p-aminophenol, N-$\beta$-hydroxyethyl)-p-aminophenol, N-(4-hydroxyphenyl)glycine, 2-methyl-p-aminophenol and p-benzylaminophenol with N-methyl-p-aminophenol being preferred.

The dihydroxybenzene type developing agent is usually used at a preferred concentration of 0.05 to 0.8 mole/1. Where a combination of dihydroxybenzenes with 1-phenyl-3-pyrazolidones or p-amino-phenols is used, they are preferably used at concentrations of 0.05 to 0.5 mole/1 and 0.06 mole/1 or less, respectively.

Exemplary sulfite preservatives include sodium sulfite, potassium sulfite, lithium sulfite, sodium bisulfite, potassium metabisulfite, and sodium formaldehyde bisulfite. Sulfite is used at a concentration of at least 0.3 mole/l. However, if too much salt is added, it precipitates in the developer to cause liquid contamination. Accordingly, a preferred upper limit is 1.2 moles/l.

A pH value of the developer according to the invention is set to a range of from 10.5 to 12.3. Conventional water-soluble inorganic alkali metal salts (e.g., sodium hydroxide, sodium carbonate, potassium phosphate) may be used as an alkali agent used for adjusting the pH value.

The developer used in the invention may further contain pH buffers such as boric acid, borax, sodium phosphate and potassium phosphate; developing restrainers such as potassium bromide and potassium iodide; organic solvents such as ethylene glycol, diethylene glycol, triethylene glycol, dimethyl formamide, methyl cellosolve, hexyleneglycol, ethanol and methanol; and antifoggants or black pepper inhibitors such as indazole compounds (e.g., 5-nitroindazole) and benztriazole compounds (e.g., 5-methylbenztriazole). When compounds such as 5-nitroindazole are used, it is usual that they are dissolved in advance separately from a solution containing the dihydroxybenzene developing agent and the sulfite preservative, and both are admixed before used, and water is added. Further, it is convenient for handling to make alkaline the solution containing dissolved 5-nitroindazole, whereby the solution turns yellow.

The amino compounds described in U.S. Pat. No. 4,269,929, Japanese Patent Publication (unexamined) No. 258537/1985 and Japanese Patent Application No. 109743/1985 may be included. The pH of the developer can be lowered by the use of amino compounds, which enhances stability of the liqud itself.

Further, color tone agents, surfactants, hard water-softeners and hardening agents may be contained, if necessary.

As a fixer, those having the usual compositions may be used. Exemplary fixing agents include thiosulfates and thiocyanates as well as organic sulfur compounds which are known as having an effect of a fixing agent. In addition, a ferric ethylenediaminetetraacetate complex may be used as an oxidizing agent.

A treatment temperature is usually selected in a range of from 18° C. to 50° C. However, a temperature below 18° C. or above 50° C. may be used.

The method according to the invention is particularly suitable for quick treatment in an automatic processor. As the automatic processor, a roller conveying type, a belt conveying type and any other types may be used. A short treatment time is sufficient. The method of the invention exhibits sufficient effect even under quick treatments of 2 minutes or less, particularly 100 seconds or less, of which 15 to 60 seconds are used for development.

As the hydrazine derivative contained in silver halide photographic light-sensitive materials used in the present invention, compounds represented by the following general formula (I) are preferably used:

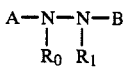

(I)

wherein A represents an aliphatic or aromatic group; B represents a formyl, acyl, alkyl- or arylsulfonyl, alkyl- or arylsulfinyl, carbamoyl, akoxy- or aryloxycarbonyl, sulfinamoyl, alkoxysulfonyl, thioacyl, thiocarbamoyl or heterocyclic group; and $R_0$ and $R_1$ both represent a hydrogen atom or either one of $R_0$ and $R_1$ represents a hydrogen atom and the other one represents a sustituted or unsubstituted alkylsulfonyl, substituted or unsubstituted arylsulfonyl, or substituted or unsubstituted acyl group, provided that B, $R_1$ and a nitrogen atom to which B and $R_1$ are bound may form a partial structure of hydrazine, —N=C<.

In general formula (I), the aliphatic group represented by A is preferably one having 1 to 30 carbon atoms, particularly a linear, branched or cyclic alkyl group having 1 to 20 carbon atoms. The branched alkyl group herein may be cyclic so as to form a saturated hereto ring containing one or more hetero atoms. The alkyl group may have substituents such as an aryl, alkoxy, sulfoxy, sulfonamide and carbonamide groups.

For instance, there may be named t-butyl, n-octyl, t-octyl, cyclohexyl, pyrrolidyl, imidazolyl, tetrahydrofuryl and morpholino groups.

The aromatic group represented by A in general formula (I) is a monocyclic or dicyclic aryl group or an unsaturated heterocyclic group. The unsaturated heterocyclic group herein may be condensed with a monocyclic or dicyclic aryl group to form a heteroaryl group.

For instance, there may be named benzene, naphthalene, pyridine, pyrimidine, imidazole, pyrazole, quinoline, isoquinoline, benzimidazole, thiazole, and benzothiazole rings. Above all, those containing a benzene ring are preferred.

A particularly preferred group represented by A is an aryl group.

The aryl or unsaturated heterocyclic group as A may have substituents. Typical substituents are linear, branched and cyclic alkyl groups having preferably 1 to 20 carbon atoms, aralkyl groups, preferably monocyclic or dicyclic ones having 1 to 3 carbon atoms in the alkyl moiety, alkoxy groups having preferably 1 to 20 carbon atoms, substituted amino groups, preferably amino groups substituted with alkyl groups having 1 to 20 carbon atoms, acylamino groups having preferably 2 to 30 carbon atoms, sulfonamide groups having preferably 1 to 30 carbon atoms, and ureido groups having preferably 1 to 30 carbon atoms.

Into A of the general formula (I), there may be incorporated a ballast group which is conventionally used in a photographic immobile additive such as a coupler. The ballast groups is a groups which has at least 8 carbon atoms and is relatively less influential to photographic properties. This may be selected from, for instance, alkyl, alkoxy, phenyl, alkylphenyl, phenoxy, and alkylphenoxy groups.

Into A of the general formula (I), there may be incorporated a group which enhances adsorption to the surface of silver halide grains. Such an adsorption group includes those described in, for instance, U.S. Pat. Nos. 4,385,108 and 4,459,347, Japanese Patent Applications (unexamined) Nos. 195233/1984, 200231/1984, 201045/1984, 201046/1984, 201047/1984, 201048/1984, 201049/1984, and 179734/1985, Japanese Patent Applications Nos. 11459/1985 and 19739/1985, such as thiourea, heterocyclic thioamide, mercapto heterocyclic, and triazol groups.

Examples of B include formly, acyl such as acetyl, propionyl, trifluoroacetyl, chloroacetyl, benzoyl, 4-chlorobenzoyl, pyruvoyl, methoxyallyl and methyloxamoyl; alkylsulfonyl such as methanesulfonyl and 2-chloroethanesulfonyl; arylsulfonyl such as benzenesulfonyl; alkylsulfinyl such as methanesulfinyl; arylsulfinyl such as benzenesulfinyl; carbamoyl such as methylcarbamoly and phenylcarbamoyl; sulfamoyl such as dimethylsulfamoyl; alkoxycarbonyl such as methoxycarbonyl and methoxyethoxycarbonyl; aryloxycarbonyl such as phenoxycarbonyl; sulfinamoyl such as methylsulfinamoyl; alkoxysulfonyl such as methoxysulfonyl and ethoxysulfonyl; thioacyl such as methylthiocarbonyl; thiocarbamoyl such as methylthiocarbamoyl; and heterocyclic groups such as a pyridine ring.

Formyl and acyl groups are particularly preferred as B.

B in the general formula (I) may form a partial structure of hydrazine,

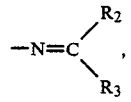

together with $R_1$ and a nitrogen atom to which B and $R_1$ are found.

In the above, $R_2$ represents an alkyl, aryl or heterocyclic group, and $R_3$ represents a hydrogen atom, alkyl, aryl or heterocyclic group.

$R_0$ and $R_1$ represent a hydrogen atom, an alkyl sulfonyl group having less than 21 carbon atoms or arylsulfonyl group, preferably a phenylsulfonyl group or so substituted phenylsulfonyl group that the sum of Hammett's substituent constants is at least −0.5; an aryl group having less than 21 carbon atoms, preferably a benzoyl group or so substituted benzoyl group that the sum of Hammett's substituent constants is at least −0.5, or a linear, branched or cyclic, substituted or unsubstituted aryl group with preference for halogen atoms, ether, sulfonamide, carbonamide, hydroxyl, carboxy and sulfonic acid groups as a substituent.

A hydrogen atom is most preferred as $R_0$ and $R_1$.
The following are examples of the hydrazine derivatives used in the present invention, though the invention is not limited to those.
I-1
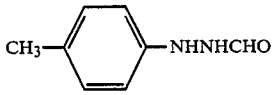
I-2
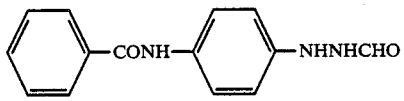
I-3
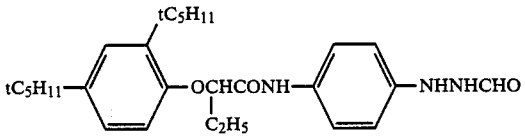
I-4
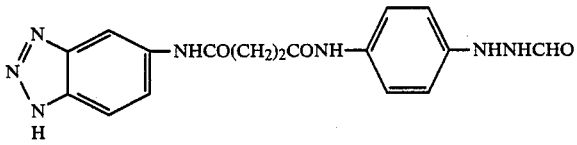
I-5
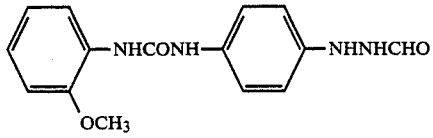
I-6
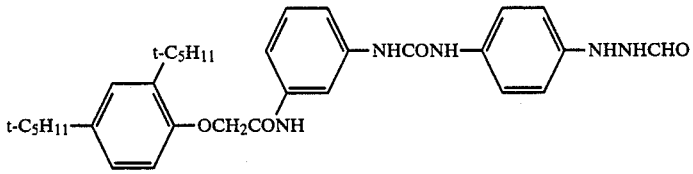
I-7
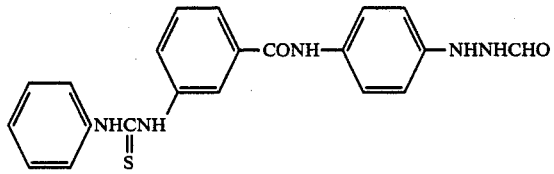
I-8
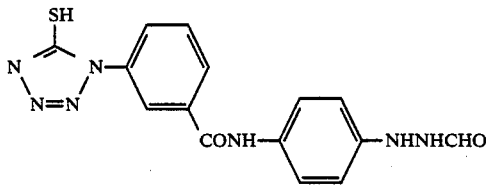
I-9
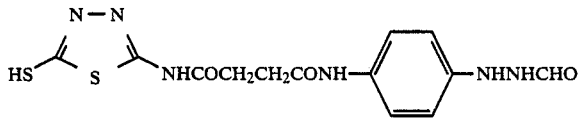

-continued
I-10
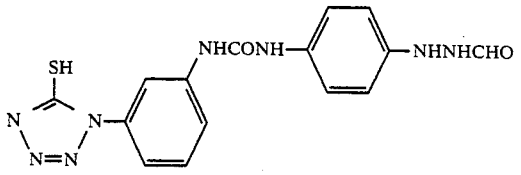
I-11
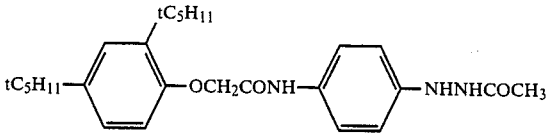
I-12
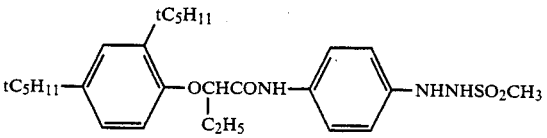
I-13
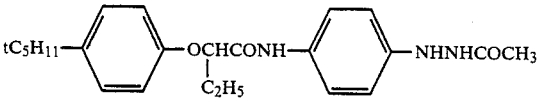
I-14
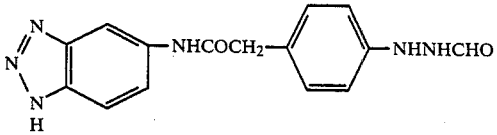
I-15
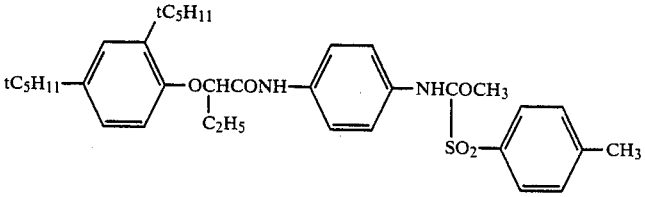
I-16
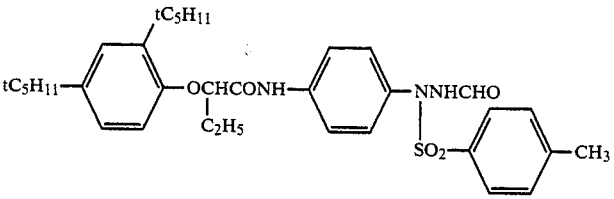
I-17
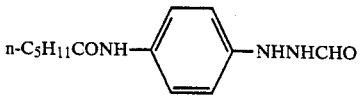
I-18
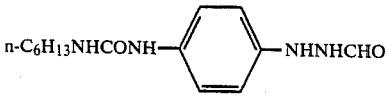
I-19
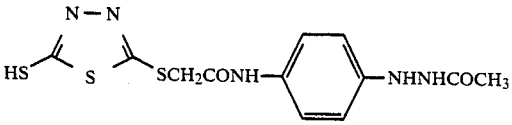

-continued

I-20

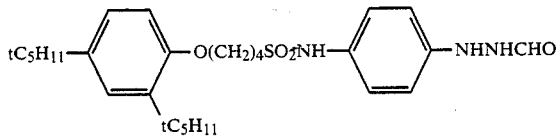

I-21

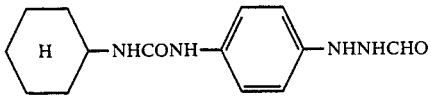

When the hydrazine derivative is incorporated in the photographic light-sensitive materials, it is preferred to incorporate the derivative in a silver halide emulsion layer, but the derivative may also be contained in other non-light-sensitive hydrophilic colloid layers such as a protective layer, an intermediate layer, a filter layer and an antihalation layer.

Specifically, a compound to be used may be added to a hydrophilic colloid solution as an aqueous solution if the compound is water-soluble or as a solution in an organic solvent such as alcohols, esters and ketones if the compound is hardly water-soluble. When the compound is added to a silver halide emulsion layer, the addition may preferably be done at any time after the beginning of chemical ripening before coating. It is particualrly preferred to add the compound to a coating liquid prepared for coating.

A content of the hydrazine derivative is preferably selected depending on a grain size of a silver halide emulsion, halogen composition, a manner and degree of chemical sensitization, relation between a layer containing this compound and a silver halide emulsion layer, type of an antifoggant compound and so on. A test method for this selection is well known among those skilled in the art. Usually, this compound is used in a range of from $1\times10^{-6}$ mole to $1\times10^{-1}$ mole, particularly from $1\times10^{-5}$ mole to $4\times10^{-2}$ mole, per mole of silver halide.

Hereinafter, the silver halide photographic light-sensitive materials to which the present invention for forming images is applied will be explained below.

The silver halide emulsion used in the invention is a negative working emulsion. There is no particular limitation on halogen composition and any composition out of silver chloride, silver chlorobromide, silver iodobromide, silver bromide and silver iodobromochloride may be used. However, it is preferred that a content of silver iodide is 5 mole % or less, particularly 3 mole % or less. Silver halide grains in a photographic emulsion used in the present invention may have a relatively broad grain size distribution, but preferably have a narrow grain size distribution. Particularly, it is preferred that 90% by weight as well as by number of the whole silver halide grains has a grain size within the average grain size ±40%. Such an emulsion is called a monodispersed emulsion.

The silver halide grains used in the invention are preferably micrograins having, for instance, a size of 0.7 μ or less, particularly 0.4 μ or less.

The silver halide grains in the photographic emulsion may be regular grains having a regular crystal form such as cubic or octahedron. Alternatively, the grains may be of an irregular crystal structure such as spherical or plane, or a composite crystal form thereof.

The silver halide grains may be composed of a uniform phase both in the core and the shell, or of different phases.

Two or more types of silver halide emulsions which are separately prepared may be used as a mixture.

In the silver halide emulsion used in the present invention, cadmium salts, sulfites, lead salts, thallium salts, iridium salts or complex thereof, rhodium salts or complex thereof may coexist in a process of formation or physical ripening of the silver halide grains.

The silver halide emulsion may be a primitive emulsion, so-called non-after-ripened emulsion which is not chemically sensitized, but may also be chemically sensitized. For chemical sensitization, methods described in, for instance, H. Frieser, Die Grund-lagen der Photographischen Prozesse mit Silver halogeniden, Akademische Verlagsgesselschaft, 1968) may be used.

That is, a sulfur sensitization method using a compound containing sulfur capable of reacting with active gelatin and silver, such as thiosufates, thioureas, mercapto compounds and rhodanines, a reduction sensitization method using a reducing substance such as stannates (I), amines, hydrazine derivatives, formamidinesulfinic acid and silane compounds, and a noble metal sensitization method using noble metal compounds such as gold compounds or complex of metals of Group VIII of the periodic table such as platinum, iridium and palladium may be used alone or in combination.

Gelatin is preferably used as a binder or a protective colloid which may be used in an emulsion layer or intermediate layer of the light-sensitive materials according to the invention, but other hydrophilic colloids may also be used.

For instance, there may be used proteins such as gelatin derivatives, graft polymers of gelatin with other polymer, albumin and casein; cellulose derivatives such as hydroxyethyl cellulose, carboxymethyl cellulose and cellulose sulfuric ester; sugar derivatives such as sodium alginate and starch derivatives; and various synthetic hydrophilic polymeric substances, e.g., homo- or copolymer such as polyvinyl alcohol, partial acetal of polyvinyl alcohol, poly-N-vinylpyrrolidone, polyacrylic acid, polymethacrylic acid, polyacrylamide, polyvinylimidazole and polyvinylpyrazole.

For gelatin, lime-treated gelatin as well as acid-treated gelatin and enzyme-treated gelatin as described in Bull. Soc. Sci. Phot. Japan, No. 16, 30 (1966), may be used. Further, hydrolysis products and enzymatically hydrolized products of gelatin may also be used.

The photographic emulsion used in the present invention may be spectrally sensitized by methine dyes or others. Useful dyes include cyanine dyes, merocyanine dyes, complex cyanine dyes, complex merocyanine dyes, holopolar cyanine dyes, hemicyanine dyes, stylyl dyes and hemioxonol dyes. Particularly useful dyes are those pertaining to groups of cyanine dyes, merocyanine dyes and complex merocyanine dyes. These dyes may be used in combination so as to obtain supersensitization.

The emulsion may contain a dye which has no spectral sensitizing effect in itself or a substance which does substantially not absorb visual light but shows supersensitization, together with the sensitizing dyes. For instance, aminostylbene compounds substituted at a nitrogencontaining heterocyclic group, such as those described in U.S. Pat. Nos. 2,933,390 and 3,635,721, aromatic organic acid-formaldehyde condensates such as those described in U.S. Pat. No. 3,743,510, cadmium salts and azaindene compounds may be contained. Particularly useful are combinations described in U.S. Pat. Nos. 3,615,613; 3,615,641; 3,617,295; and 3,635,721.

In the photographic emulsion used in the present invention, various compounds may be contained to prevent fogging during preparation, storage or photographic treatment or to stabilize photographic properties. That is, various compounds known as antifoggant or stabilizer, for instance, azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles, particularly 1-phenyl-5-mercaptotetrazole; mercaptopyrimidines; mercaptotriazine; thioketo compounds such as oxazolinethiones; azaindenes such as triazaindenes and tetrazaindenes, particularly 4-hydroxy-substituted (1, 3, 3a, 7) tetrazaindenes, and pentazaindenes; benzenethiosulfonic acid, benzenesulfinic acid and benzenesulfonic acid amide may be added.

Among these, particularly preferred are benzotriazoles such as 5-methyl benzotriazole, and nitroindazoles such as 5-nitroindazole. Further, these compounds may be contained in a treatment liquid.

The photographic light-sensitive materials used in the invention may contain an inorganic or organic hardener in a photographic emulsion layer or in other hydrophilic colloid layers. For instance, chromium salts such as chromium alum and chromium acetate, aldehydes such as formaldehyde, glyoxal and glutaraldehyde, N-methylol compounds such as dimethylol urea and methylol dimethylhydantoin, dioxane derivatives such as 2,3-dihydroxy dioxane, active vinyl compounds such as 1,3,5-triacryloyl-hexahydro-s-triazine and 1,3-vinylsulfonyl-2-propanol, active halogen compounds such as 2,4-dichloro-6-hydroxy-s-triazine, mucohalogenic acids such as mucochloric acid and mucophenoxychloric acid may be used alone or in combination.

Further, in a photographic emulsion layer or other hydrophilic colloid layers of the light-sensitive material used in the invention, various surfactants may be contained as a coating aid or for various purposes, e.g., antistatic, improvement of a slipping property, emulsification or dispersion, prevention of adhesion and improvement of photographic properties such as development acceleration, high contrasting and sensitization.

For instance, nonionic surfactants, e.g., saponin of a steroid type, alkylenoxide derivatives such as polyethylene glycols, polyethylene glycol/polypropylene glycol condensates, polyethylene glycol alkylethers or polyethylene glycol alkylarylesters, polyethylene glycol esters, polyethylene glycol sorbitanesters, polyalkylene glycol alkylamines or amides, and adducts of silicone with polyethylene oxide, glycidol derivatives such as alkenyl succinic acid polyglyceride and alkylphenol polyglyceride, aliphatic acid esters of polyalcohols, and alkylesters of sugars; anionic surfactants having acidic groups such as carboxyl, sulfo, phospho, sulfuric acid ester and phosphoric acid ester groups, e.g., alkylcarboxylic acid salts, alkylsulfonic acid salts, alkylbenzenesulfonic acid salts, alkylnaphthalenesulfonic acid salts, alkylsulfuric acid esters, alkylphosphoric acid esters, N-acyl-N-alkyltaurines, sulfosuccinic acid esters, sulfoalkylpolyoxyester alkylphenylethers and polyoxyethylene alkylphosphoric acid esters; amphoteric surfactants, e.g., amino acids, aminoalkylsulfonic acids, aminoalkylsulfuric acid or -phosphoric acid esters, alkyl betaines and amine oxides; and cationic surfactants, e.g., alkylamine salts, aliphatic or aromatic quaternary ammonium salts, heterocyclic quaternary ammonium salts such as pyridinium and imidazolium, and phosphonium or sulfonium salts containing an aliphatic group or a heterocyclic group may be used.

Surfactants which are particularly preferred in the present invention are polyalkylene oxides having a molecular weight of at least 600 described in Japanese Patent Publication 9412/1983.

The photographic light-sensitive materials used in the invention may contain a dispersion of a water-insoluble or hardly water-soluble synthetic polymer in a photographic emulsion layer or in an other hydrophilic colloid layer for improvement of dimentional stability and so on. For instance, there may be used polymers composed of monomers, such as, alkyl meth)acrylate, alkoxyalkyl (meth)acrylate, glycidyl (meth)acrylate, (meth)acrylamide, vinyl ester (e.g., vinyl acetate), acrylonitrile, olefines and styrene alone or in combination, or a combination thereof with acrylic acid, methacrylic acid, $\alpha$, $\beta$-unsaturated dicarboxylic acid, hydroxyalkyl (meth)acrylate, sulfoalkyl (meth)acrylate, and syrenesulfonic acid.

Further, dyes, desensitizing agents, plasticizers, lubricants and the like may be used in a photographic emulsion layer or other hydrophilic colloid layers of the photographic light-sensitive materials used in the invention.

For these additives and the previously-mentioned additives, those described in Research Disclosure, 176, No. 7643, (December 1978), p.22 to 28, may be used.

The invention will further be described in the following Examples.

EXMAPLE 1

To a silver iodobromide emulsion of 0.3 $\mu$ cubic grains containing 2.5 mol % of iodide, there were added anhydro-5,5-dichloro-9-methyl-3,3'-bis (3-sulfopropyl) oxacarbocyanine hydroxide sodium salt (sensitizing dye) at a content of 230 mg/mole of silver, a hydrazine derivative (molecular weight about 1000) at 300 mg/mole of silver, and, further, 5-methylbenztriazole, 4-hydroxy-6-methyl-1,3,3a,7-tetrazaindene, a dispersion of polyethylacrylate and 2-hydroxy-1,3,5-triazine sodium salt were added. The coating liquid thus prepared was coated on a polyethylene terephthalate film substrate so that a coated silver amount was 4.0 g/m$^2$ and a coated gelatin amount was 2.5 g/m$^2$, on which a protective layer was provided so that a coated gelatin amount was 1.0 g/m$^2$ to obtain film A.

This film was exposed through an exposure wedge for sensitometry using a 150 lines magenta contact screen, developed with a developer having the following composition (Table 1) at 38° C. for 30 seconds, fixed, washed with water.and dried. In the treatment, an automatic processor FG 660F (Fuji Photo Film Co., Ltd.) was used.

TABLE 1

| | Starting Developer A | Replenisher B | Replenisher C | Replenisher D |
|---|---|---|---|---|
| Tetrasodium ethylendiaminetetraacetate | 1.0 g | 1.0 g | 1.0 g | 1.0 g |
| Sodium hydroxide | 9.0 g | 6.0 g | 9.0 g | 9.0 g |
| Potassium phosphate | 74.0 g | 74.0 g | 74.0 g | 74.0 g |
| Potassium sulfite | 90.0 g | 90.0 g | 90.0 g | 90.0 g |
| 5-Methyl benztriazole | 0.30 g | 0.30 g | 0.30 g | 0.50 g |
| Sodium bromide | 3.0 g | 3.0 g | 3.0 g | 3.0 g |
| N—methyl-p-aminophenol ½ sulfate | 1.0 g | 1.0 g | 1.0 g | 1.0 g |
| Hydroquinone | 35.0 g | 35.0 g | 35.0 g | 35.0 g |
| n-Butyl diethanol amine | 10.0 g | 10.0 g | 10.0 g | 10.0 g |
| Sodium p-toluenesulfonate | 15.0 g | 15.0 g | 15.0 g | 15.0 g |
| Water to | 1 l | 1 l | 1.2 l | 1 l |
| pH | 11.6 | 11.5 | 11.5 | 11.6 |

Note:
Replenisher B had a pH lower than that of starting developer A.
Replenisher C was obtained by adding 0.2 liter of water to 1 liter of starting developer A.
Replenisher D contained a larger amount of 5-methylbenztriazole than that in starting developer A.

Activities of liquids A, B, C and D shown in Table 1 were determined, which are shown in Table 2. In Table 2, a reciprocal of an exposure value required to obtain an optical density of 1.5 in treatment of film A with starting developer A at 38° C. for 30 seconds was taken as 100. The other numerals were relative values to this.

TABLE 2

| Starting Developer A | Replenisher B | Replenisher C | Replenisher D |
|---|---|---|---|
| 100 | 80 | 80 | 80 |

It was found in experiments that, when replenishers B, C and D were added to starting developer A, a proper amount of the replenishers was 3 litersper day in an automatic processor FG 660F used in this Example.

This value, 3 liters, was determined as follows: The automatic processor was operated for a day using only starting developer A without supplying a replenisher and the operation was stopped for a night. Then, the processor was restarted next morning. At this time, the amount of the less active replenisher required to adjust the liquid activity to the same level of the liquid activity at the starting point in the previous day was determined by experiments. Herein, a liquid activity was evaluated by sensitivity of the light-sensitive materials.

In all of experiment conditions 1, 2, 3 and 4, starting developer A was used. 100 ml of a replenisher were supplied for treatment of every one piece of a sheet (50.8 cm×61.0 cm), half the area of which was exposed. As this replenisher, starting developer A was used in experiment condition 1; replenisher B in experiment condition 2; replenisher C in experiment condition 3; and replenisher D in experiment condition 4. 30 Pieces of the sheet were treated every day and 3 of each of the replenishers were supplied to each of the developers every day. The operations were repeated for 14 days to obtain the results as shown in Table 3.

TABLE 3

| | Exp. Condition 1 (Comparision) | | Exp. Condition 2 (Invention) | | Exp. Condition 3 (Invention) | | Exp. Condition 4 (Invention) | |
|---|---|---|---|---|---|---|---|---|
| | Fresh Liquid | 14th day | Fresh Liquid | 14th day | Fresh Liquid | 14th day | Fresh Liquid | 14th day |
| Sensitivity | 100 | 120 | 100 | 100 | 100 | 100 | 100 | 100 |
| Dot Quality | 5 | 3 | 5 | 5 | 5 | 5 | 5 | 5 |
| Black Pepper | 5 | 1 | 5 | 5 | 5 | 5 | 5 | 5 |

The dot quality was rated into 5 grades. "5" was best and "1" was worst. A half-tone original film for photomechanical process of a rating of "5" or "4" is usable; one of a rating of "3" is poor but narrowly usable; and one of a rating of "2" or "1" cannot be used.

"Black pepper" describes a phenomenon that black silver images irregularly appear in non-image areas. This was rated into 5 grades. "5" represents absence of black pepper. "1" represents the worst quality where a lot of black peppers appear. A half-tone original film for photomechanical process of a rating of "5" or "4" is usable; one of a rating of "3" is poor but narrowly usable; and one of a rating of "2" or "1" cannot be used.

As seen from the results in Table 3, in experiment condition 1 where starting developer A was used as a replenisher, the sensitivity rose after the running treatment for 14 days, the dot quality deteriorated, and a lot of black peppers appeared. In contrast, in experiment conditions 2, 3 and 4 where a replenisher less active than the starting developer was used, the sensitivity did not change after the running treatment for 14 days, the dot quality did not deteriorate, and no black pepper appeared.

EXAMPLE 2

This example demonstrates comparison between the case where a less active replenisher was supplied at a rate of 100 ml-per piece of 50.8 cm×61.0 cm up to a treatment amount of 30 pieces per day and then starting developer A was supplied after 30th piece (according to the invention) and the case where a less active replenisher was supplied even after 30th piece (for comparison).

That is, replenishing conditions for every day were set as follows.

TABLE 4

| | 1st to 30th piece of 50.8 cm × 61.0 cm | 31th to 100th piece of 50.8 cm × 61.0 cm |
|---|---|---|
| Experiment Condition 5 (Comparison) | To supply 100 ml of replenisher B per piece | To supply 100 ml of replenisher B per piece |
| Experiment Condition 6 (Invention) | To supply 100 ml of replenisher B per piece | To supply 100 ml of starting developer A per piece |
| Experiment Condition 7 (Comparison) | To supply 100 ml of replenisher C per piece | To supply 100 ml of replenisher C per piece |
| Experiment Condition 8 (Invention) | To supply 100 ml of replenisher C per piece | To supply 100 ml of starting developer A per piece |

Running treatment for 14 days was carried out in the same conditions as in Example 1 with the exception that the replenishing conditions for every day were set as shown in Table 4. The results are shown in Table 5.

TABLE 5

| | Exp. Condition 5 (Comparison) | | Exp. Condition 6 (Invention) | | Exp. Condition 7 (Comparision) | | Exp. Condition 8 (Invention) | |
|---|---|---|---|---|---|---|---|---|
| | Fresh Liquid | 14th day | Fresh Liquid | 14th day | Fresh Liquid | 14th day | Fresh Liquid | 14th day |
| Sensitivity | 100 | 85 | 100 | 100 | 100 | 85 | 100 | 100 |
| Dot Quality | 5 | 3 | 5 | 5 | 5 | 3 | 5 | 5 |
| Black Pepper | 5 | 5 | 5 | 5 | 5 | 5 | 5 | 5 |

As seen from Table 5, the decrease in sensitivity and deterioration in the dot quality were large in Experiment Conditions 5 and 7 where 100 pieces of the sheet (50.8 cm×61.0 cm) per day were treated for 14 days using replenisher B or C less active than the starting developer in a replenished amount of 10 l in total per day. On the other hand, in Experiment Conditions 6 and 8 according to the invention, replenisher B or C less active than the starting developer was supplied up to 3 l per day and, after the quantity of the supplied replenisher exceeded 31 , the starting developer A was supplied, whereby the sensitivity, the dot quality and appearance of black pepper did not change after the repeated running operations for 14 days.

EXAMPLE 3

This example demonstrates comparison between the case where a less active replenisher was supplied at a rate of 100 ml per 50.8 cm×61.0 cm sheet up to 10 sheets per day (comparison) and the case where 2 l were additionally supplied at the end of every day to make up for deficiency to 3 l/day (invention).

That is, 10 sheets were treated every day in the following replenishing conditions.

TABLE 6

| | | |
|---|---|---|
| Experiment Condition 9 (Comparison) | To supply 100 ml of replenisher B per sheet | Replenishment of 1 l in total per day |
| Experiment Condition 10 (Invention) | To supply 100 ml of replenisher B per sheet and, at the end of every day, supply 2 l of replenisher B | Replenishment of 3 l in total per day |
| Experiment Condition 11 (Comparison) | To supply 100 ml of replenisher C per sheet | Replenishment of 1 l in total per day |
| Experiment Condition 12 (Invention) | To supply 100 ml of replenisher C per sheet and, at the end of every day, supply 2 l of replenisher C | Replenishment of 3 l in total per day |

Running treatment for 14 days was carried out in the conditions as in Example 1 with the exception that the replenishing conditions for every day were set as shown in Table 6. The results are shown in Table 7.

TABLE 7

| | Exp. Condition 9 (Comparison) | | Exp. Condition 10 (Invention) | | Exp. Condition 11 (Comparison) | | Exp. Condition 12 (Invention) | |
|---|---|---|---|---|---|---|---|---|
| | Fresh Liquid | 14th day | Fresh Liquid | 14th day | Fresh Liquid | 14th day | Fresh Liquid | 14th day |
| Sensitivity | 100 | 120 | 100 | 100 | 100 | 120 | 100 | 100 |
| Dot Quality | 5 | 3 | 5 | 5 | 5 | 3 | 5 | 5 |
| Black Pepper | 5 | 1 | 5 | 5 | 5 | 1 | 5 | 5 |

As seen from Table 7, rise in sensitivity, deterioration in dot quality and appearance of black peppers were remarkable in Experiment Conditions 9 and 11 where 10 pieces of 50.8 cm×61.0 cm sheet per day were treated for 14 days using replenisher B or C less active than the starting developer in a replenished amount of 1 l in total per day. On the other hand, in Experiment Conditions 10 and 12 according to the invention, 1 l of reprenisher was supplied per day up to 10 pieces at a rate of 100 ml per piece of the sheet and, at the end of every day, 2 l of replenisher B or C were additionally supplied to make up for deficiency to 3 l per day. Repeated running treatment was carried out for 14 days. Sensitivity, dot quality and appearance of black peppers did not change from those of the fresh liquid and good results were obtained.

As demonstrated in Examples 1, 2 and 3, photographic properties are stabilized for a long time by the method of supplying 3 l/day of replenisher B, C or D less active than the starting developer wherein a deficient amount to 3 l/day is supplied at the end of every day in the case of a small amount of treated film, and the starting developer is used as an additional replenisher when a large amount of film is treated whereby a replenisher amounts to 3 l per day.

According to the invention, silver halide photographic materials containing a hydrazine derivative may be stably treated for a long time using an automatic processor. That is, high contrast images can be obtained for a long time without change in sensitivity and dot quality and appearance of black peppers.

What is claimed is:

1. A method of high-contrast developing of an image-wise exposed silver halide photographic light-sensitive material containing a hydrazine derivative, said process comprising (i) developing said material with a developing solution in an automatic processor, (ii) supplying a first replenisher to a developing bath of the processor in an amount based on time, and (iii) supplying a second replenisher if the amount of necessary replenisher exceeds that of the first replenisher, wherein said first replenisher has an activity such that it requires a longer time to obtain the same optical density in the treatment of the image-wise exposed material than the time which would be required of the developing solution at the beginning of development at the same temperature, and wherein the second replenisher has an activity which is substantially the same as that of the developing solution at the beginning of development.

2. The method of claim 1, wherein said first replenisher is selected from the group consisting of a liquid having a pH lower than that of the starting developing solution, a liquid obtained by diluting the starting developing solution with water, a liquid containing an antifoggant in an amount larger than that in the starting developing solution and a liquid containing a developing agent in an amount smaller than that of the starting developing solution.

3. The method of claim 1, wherein said first replenisher is a liquid having a pH lower than that of the starting developer by 0.05 to 0.2.

4. The method of claim 1, wherein said first replenisher is a liquid obtained by diluting the starting developer with water at a ratio of water/the starting developing solution of 0.05 to 0.2.

5. The method of claim 1, wherein the first replenisher solution is added for about 24 hours.

6. The method of claim 1, wherein the developing solution contains a dihydroxybenzene compound as a developing agent in an amount of 0.05 mole/l to 0.8 mole/l.

7. The method of claim 6, wherein said dihydroxybenzene compound is hydroquinone.

8. The method of claim 6, wherein said starting developer contains a p-aminophenol compound or a 3-pyrazolidone compound as an auxiliary developing agent in an amount of 0.06 mole/l or less.

9. The method of claim 8, wherein said P-aminophenol compound is N-methyl-P-aminophenol.

10. The method of claim 1, wherein the developing solution has a pH of 10.5 to 12.3.

11. The method of claim 1, wherein said hydrazine derivative is a compound represented by the formula (I):

$$A-\underset{\underset{R_0}{|}}{N}-\underset{\underset{R_1}{|}}{N}-B \qquad (I)$$

wherein A represents an aliphatic or aromatic group; B represents a formyl, acyl, alkyl- or arylsulfonyl, alkyl- or arylsulfinyl, carbamoyl, alkoxy- or aryloxycarbonyl, sulfinamoyl, alkoxysulfonyl, thioacyl, thiocarbamoyl or heterocyclic group; and $R_0$ and $R_1$ both represent a hydrogen atom or either one of $R_0$ and $R_1$ represents a hydrogen atom and the other one represents a substituted or unsubstituted alkylsulfonyl, substituted or unsubstituted arylsulfonyl, or substituted or unsubstituted acyl group, provided that B, $R_1$ and a nitrogen atom to which B and $R_1$ are bound may form a partial structure of hydrazine, $-N{=}C<$.

* * * * *